US007396211B2

(12) United States Patent
Tomberg et al.

(10) Patent No.: US 7,396,211 B2
(45) Date of Patent: Jul. 8, 2008

(54) STATOR BLADE AIRFOIL PROFILE FOR A COMPRESSOR

(75) Inventors: Steven Eric Tomberg, Simpsonville, SC (US); Venkata Siva Chaluvadi, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 351 days.

(21) Appl. No.: 11/392,514

(22) Filed: Mar. 30, 2006

(65) Prior Publication Data

US 2007/0231147 A1 Oct. 4, 2007

(51) Int. Cl.
*B64C 27/46* (2006.01)

(52) U.S. Cl. ..... 416/223 A; 416/DIG. 2; 416/DIG. 5

(58) Field of Classification Search ..... 415/191, 415/192, 208.1, 208.2; 416/223 A, 223 R, 416/243, 241 R, DIG. 2, DIG. 5
See application file for complete search history.

(56) References Cited

U.S. PATENT DOCUMENTS 6,398,489 B1 6/2002 Burdgick et al.
6,450,770 B1 * 9/2002 Wang et al. ..... 416/223 A
6,461,109 B1 10/2002 Wedlake et al.
6,461,110 B1 10/2002 By et al.
6,474,948 B1 11/2002 Pirolla et al.
6,503,054 B1 1/2003 Bielek et al.
6,503,059 B1 1/2003 Frost et al.
6,558,122 B1 * 5/2003 Xu et al. ..... 416/223 A
6,579,066 B1 * 6/2003 Saito et al. ..... 416/243
6,685,434 B1 2/2004 Humanchuk et al.
6,715,990 B1 4/2004 Arness et al.
6,722,852 B1 4/2004 Wedlake et al.
6,722,853 B1 * 4/2004 Humanchuk et al. .... 416/223 A
6,739,838 B1 5/2004 Bielek et al.
6,769,879 B1 8/2004 Cleveland et al.
6,779,977 B2 8/2004 Lagrange et al.
6,779,980 B1 8/2004 Brittingham et al.
6,808,368 B1 10/2004 Tomberg et al.
6,832,897 B2 12/2004 Urban
6,854,961 B2 2/2005 Zhang et al.
6,857,855 B1 2/2005 Snook et al.

(Continued)

FOREIGN PATENT DOCUMENTS

EP 1503037 7/2004

OTHER PUBLICATIONS

U.S. Appl. No. 11/214,499, filed Aug. 30, 2005, entitled: Stator Vane Profile Optimization.

(Continued)

*Primary Examiner*—Igor Kershteyn
(74) *Attorney, Agent, or Firm*—Nixon & Vanderhye PC

(57) ABSTRACT

Eleventh stage stator vanes for a compressor comprise airfoil profiles substantially in accordance with Cartesian coordinate values of x, Y and Z set forth in inches in Table I, wherein the Z coordinate values are perpendicular distances from planes normal to a radius from the compressor centerline and containing the X and Y values with the Z value commencing at zero in the X, Y plane at a radial aerodynamic section of the airfoil. X and Y are coordinate values defining the airfoil profile at each distance Z. The X, Y and Z values may be scaled to provide a scaled-up or scaled-down airfoil section for each stator vane.

13 Claims, 4 Drawing Sheets

U.S. PATENT DOCUMENTS

| | | | | |
|---|---|---|---|---|
| 6,866,477 | B2 | 3/2005 | Arness et al. | |
| 6,881,038 | B1 | 4/2005 | Beddard et al. | |
| 6,884,038 | B2 | 4/2005 | Hyde et al. | |
| 6,910,868 | B2 | 6/2005 | Hyde et al. | |
| 6,994,520 | B2 | 2/2006 | Humanchuk | |
| 7,001,147 | B1 | 2/2006 | Phillips | |
| 7,094,034 | B2 * | 8/2006 | Fukuda et al. | 416/223 A |
| 7,306,436 | B2 * | 12/2007 | Girgis et al. | 416/223 A |
| 7,329,092 | B2 * | 2/2008 | Keener et al. | 415/191 |
| 7,329,093 | B2 * | 2/2008 | Vandeputte et al. | 415/191 |
| 2006/0059890 | A1 | 3/2006 | Sassanelli | |
| 2006/0073014 | A1 | 4/2006 | Tomberg | |

OTHER PUBLICATIONS

U.S. Appl. No. 11/340,532, filed Jan. 27, 2006, entitled: Stator Blade Airfoil Profile for a Compressor.

UK Search Report dated Jul. 29, 2007 issued in counterpart GB Application No. GB 0706205.2.

* cited by examiner

STATOR BLADE AIRFOIL PROFILE FOR A COMPRESSOR

BACKGROUND OF THE INVENTION

The present invention relates to a compressor for a turbine and particularly relates to a stator blade airfoil profile for the compressor blades, particularly the eleventh stage blades.

The hot gas path of a turbine requires compressor airfoil stator blade profiles that meet system requirements of efficiency and loading. The airfoil shape of the compressor stator blades must optimize the interaction between other stages in the compressor, provide for aerodynamic efficiency and optimize aeromechanic life objectives. Accordingly, there is a need for a stator blade airfoil profile which optimizes these objectives.

BRIEF SUMMARY OF THE INVENTION

In a example embodiment of the invention, there is provided a stator blade for a compressor having an airfoil, the airfoil having an uncoated nominal profile substantially in accordance with Cartesian coordinate values of X, Y and Z set forth in inches in Table I wherein the Z coordinate values are perpendicular distances from planes normal to a radius from the compressor centerline and containing the X and Y values with the Z value commencing at zero in the X, Y plane at a radial aerodynamic section of the airfoil and X and Y are coordinate values which, when connected by smooth continuing arcs, refine the airfoil profile at each distance Z, the profiles at the Z distances being joined smoothly with one another to form the complete airfoil shape.

In another example embodiment of the invention, there is provided a stator blade for a compressor having an airfoil, the airfoil having an uncoated nominal airfoil profile substantially in accordance with Cartesian coordinate values of X, Y and Z set forth in inches in Table I, wherein the Z coordinate values are perpendicular distances from planes normal to a radius from the compressor centerline and containing the X and Y values with the Z values commencing at zero in the X, Y plane at a radial aerodynamic section of the airfoil and X and Y are coordinate values which, when connected by smooth continuing arcs, define the airfoil profile at each distance Z, the profiles at the Z distances being joined smoothly with one another to form the complete airfoil profile, the X, Y and Z values being scaled as a function of the same constant or number to provide a scaled-up or scaled-down compressor airfoil.

In a further example embodiment of the invention, there is provided a compressor comprising a plurality of stator blades forming a portion of a compressor stage, the airfoil having an uncoated nominal profile substantially in accordance with Cartesian coordinate values of X, Y and Z set forth in inches in Table I, wherein the Z coordinate values are perpendicular distances from planes normal to a radius from the compressor centerline and containing the X and Y values with the Z values commencing at zero in the X, Y plane at a radial aerodynamic section of the airfoil and X and Y are coordinate values which, when connected by smooth continuing arcs, define the airfoil profile at each distance Z, the profiles at the Z distances being joined smoothly with one another to form the complete airfoil shape.

DETAILED DESCRIPTION OF THE INVENTION

Figure 1:
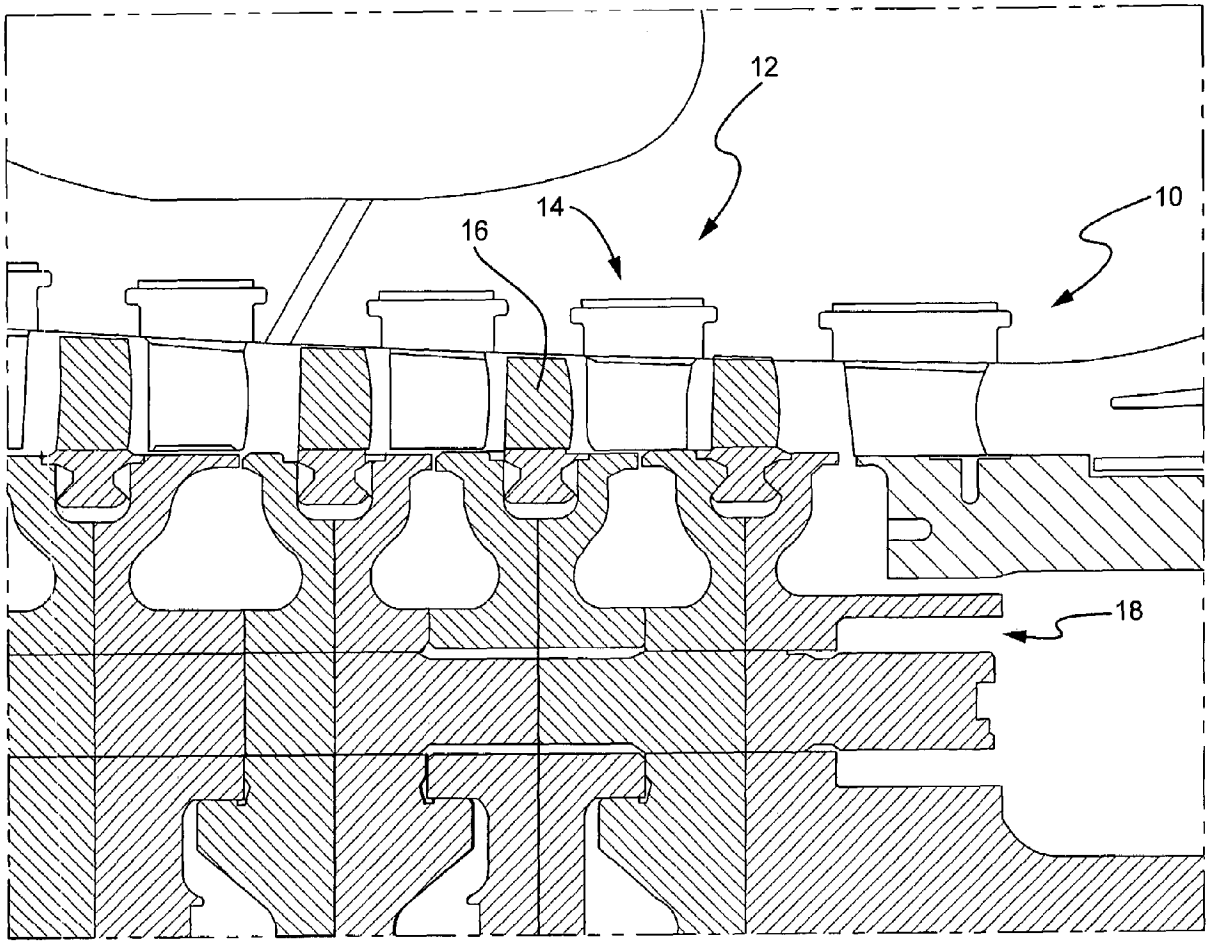
FIG. 1 is a fragmentary cross-sectional view of a compressor illustrating various stages of a compressor including the eleventh stage.
Figure 2:
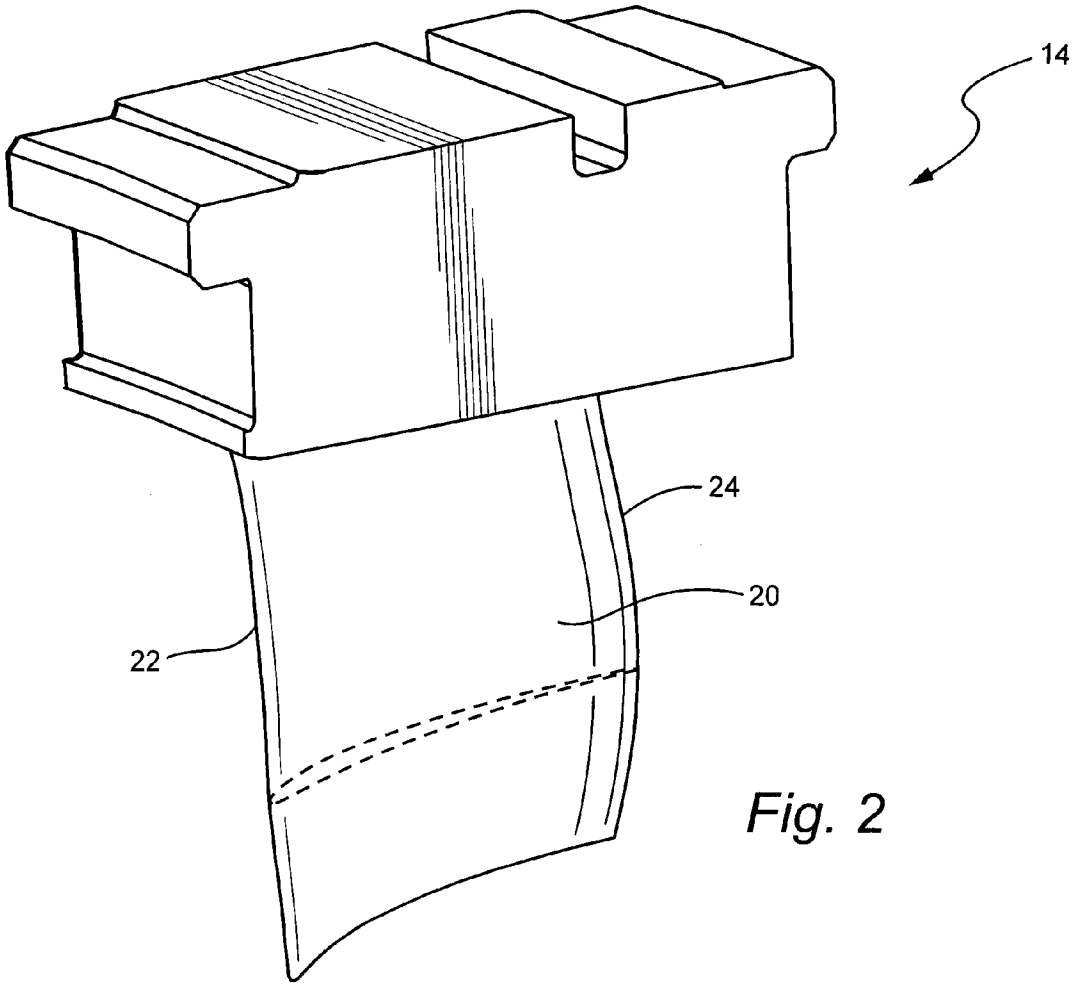
FIG. 2 is perspective view of a blade for the eleventh stage of the compressor.
Figure 3:
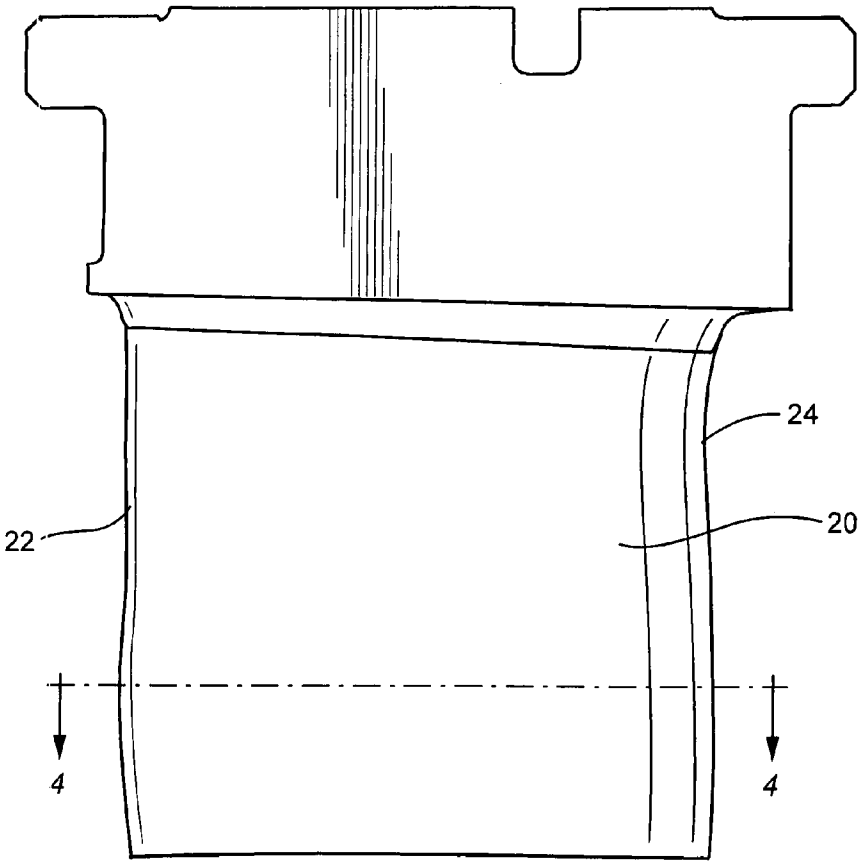
FIG. 3 is a side elevational view thereof.
Figure 4:
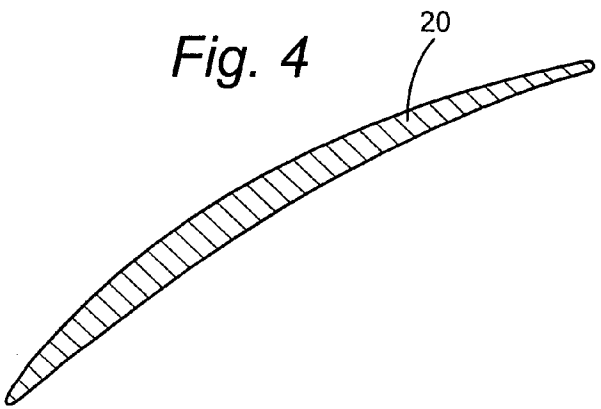
FIG. 4 is a cross-sectional view thereof taken generally about on line 4-4 in FIG. 3.
Figure 5:
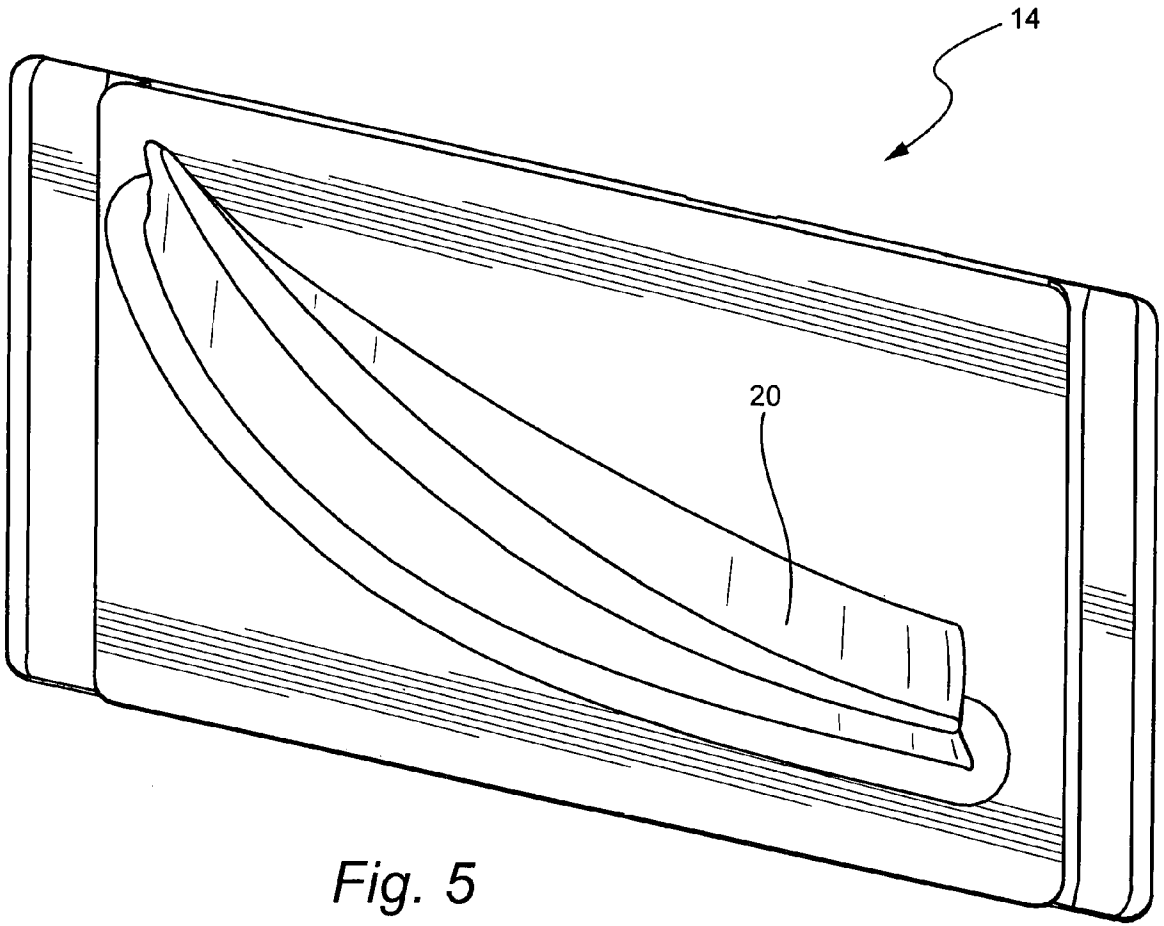
FIG. 5 is an end view of the eleventh stage compressor blade as viewed looking radially outwardly from the blade tip.

Referring now to FIG. 1, there is illustrated a portion of a compressor, generally designated 10, having multiple stages including an eleventh stage, generally designated 12. Each stage includes a plurality of circumferentially spaced stator blades 14, as well as rotor blades 16 mounted on the rotor wheel 18. The eleventh stage compressor blades 14 are circumferentially spaced one from the other, have airfoils 20 of a particular airfoil shape or profile as specified below. Referring to FIG. 2, the airfoil shape or profile includes leading and trailing edges 22 and 24, respectively.

Referring now to FIGS. 2-5, each of the eleventh stage stator blades 14 has an airfoil profile defined by a Cartesian coordinate system having X, Y and Z values. The coordinate values are set forth in inches in Table I below. The Cartesian coordinate system includes orthogonally related X, Y and Z axes with the Z axis extending along a radius from the centerline of the compressor rotor, i.e., normal to a plane containing the X and Y values. The Z distance commences at zero in the X, Y plane at the radially outermost aerodynamic blade section; the intersection of the airfoil and the OD flowpath at the stacking axis. This is commonly referred to as the root of the blade. The OD zero radius (Z=0) on the eleventh stage is at about 17.205 inches from the compressor centerline. The ID flowpath or tip of the blade is represented in the Table at a distance of about 1.524" from the OD reference point.

The X axis lies parallel to the compressor rotor centerline, i.e., the rotary axis. By defining X and Y coordinate values at selected locations in a Z direction normal to the X, Y plane, the profile of airfoil 20 can be ascertained. By connecting the X and Y values with smooth continuing arcs, each profile section at each distance Z is fixed. The surface profiles at the various surface locations between the distances Z are connected smoothly to one another to form the airfoil. The tabular values given in Table I below are in inches and represent airfoil profiles at ambient, non-operating or non-hot conditions and are for an uncoated airfoil. The sign convention assigns a positive value Z in a radially inward direction and positive and negative values for the X and Y coordinate values as typically used in Cartesian coordinate systems.

The 1232 points in Table I, below, are a nominal cold or room temperature profile for each cross section of the airfoil. As the airfoil heats up in service, stress and temperature will cause a change in XYZ's. As noted, the values for the profile given in Table I, below, are for a nominal airfoil. There are typical manufacturing tolerances, as well as coatings which must be accounted for in the actual profile of the airfoil. It will therefore be appreciated that typical manufacturing tolerances, i.e., ± values and coating thicknesses are additive to or subtractive from the X, Y values given in Table I below. A profile is the range of the variation between measured points on an airfoil surface and their ideal position listed in Table I below. The actual profile on a manufactured blade may be different than those in Table I and the design is robust to this variation, meaning that mechanical and aerodynamic function is not impaired. In this regard, a distance of ±0.100 inches in a direction normal to any surface location along the airfoil profile, defines an airfoil profile envelope for this particular airfoil design and compressor.

The coordinate values given in Table I below are in inches and provide the nominal profile envelope. In an example embodiment, the vane airfoil profiles given in Table I are for the eleventh stage blades of the compressor.

TABLE I

| X-LOC | Y-LOC | Z-LOC |
|---|---|---|
| 0.487 | −0.701 | 0.000 |
| 0.487 | −0.702 | 0.000 |
| 0.486 | −0.704 | 0.000 |
| 0.484 | −0.706 | 0.000 |
| 0.480 | −0.710 | 0.000 |
| 0.471 | −0.710 | 0.000 |
| 0.458 | −0.707 | 0.000 |
| 0.442 | −0.703 | 0.000 |
| 0.421 | −0.698 | 0.000 |
| 0.395 | −0.692 | 0.000 |
| 0.364 | −0.685 | 0.000 |
| 0.331 | −0.677 | 0.000 |
| 0.294 | −0.669 | 0.000 |
| 0.253 | −0.659 | 0.000 |
| 0.207 | −0.649 | 0.000 |
| 0.160 | −0.637 | 0.000 |
| 0.111 | −0.625 | 0.000 |
| 0.060 | −0.611 | 0.000 |
| 0.007 | −0.597 | 0.000 |
| −0.047 | −0.580 | 0.000 |
| −0.104 | −0.563 | 0.000 |
| −0.162 | −0.543 | 0.000 |
| −0.221 | −0.522 | 0.000 |
| −0.280 | −0.499 | 0.000 |
| −0.338 | −0.475 | 0.000 |
| −0.396 | −0.449 | 0.000 |
| −0.453 | −0.422 | 0.000 |
| −0.508 | −0.394 | 0.000 |
| −0.563 | −0.364 | 0.000 |
| −0.618 | −0.331 | 0.000 |
| −0.671 | −0.297 | 0.000 |
| −0.723 | −0.261 | 0.000 |
| −0.773 | −0.223 | 0.000 |
| −0.822 | −0.182 | 0.000 |
| −0.867 | −0.141 | 0.000 |
| −0.908 | −0.100 | 0.000 |
| −0.947 | −0.058 | 0.000 |
| −0.982 | −0.016 | 0.000 |
| −1.014 | 0.026 | 0.000 |
| −1.044 | 0.067 | 0.000 |
| −1.070 | 0.108 | 0.000 |
| −1.092 | 0.147 | 0.000 |
| −1.111 | 0.182 | 0.000 |
| −1.126 | 0.215 | 0.000 |
| −1.139 | 0.244 | 0.000 |
| −1.150 | 0.269 | 0.000 |
| −1.158 | 0.291 | 0.000 |
| −1.164 | 0.310 | 0.000 |
| −1.168 | 0.326 | 0.000 |
| −1.171 | 0.340 | 0.000 |
| −1.173 | 0.351 | 0.000 |
| −1.174 | 0.359 | 0.000 |
| −1.173 | 0.366 | 0.000 |
| −1.171 | 0.371 | 0.000 |
| −1.168 | 0.374 | 0.000 |
| −1.165 | 0.376 | 0.000 |
| −1.163 | 0.376 | 0.000 |
| −1.159 | 0.376 | 0.000 |
| −1.154 | 0.373 | 0.000 |
| −1.150 | 0.369 | 0.000 |
| −1.144 | 0.364 | 0.000 |
| −1.137 | 0.356 | 0.000 |
| −1.128 | 0.346 | 0.000 |
| −1.119 | 0.334 | 0.000 |
| −1.107 | 0.319 | 0.000 |
| −1.093 | 0.301 | 0.000 |
| −1.077 | 0.281 | 0.000 |
| −1.058 | 0.258 | 0.000 |
| −1.036 | 0.232 | 0.000 |

TABLE I-continued

| X-LOC | Y-LOC | Z-LOC |
|---|---|---|
| −1.011 | 0.203 | 0.000 |
| −0.982 | 0.172 | 0.000 |
| −0.950 | 0.139 | 0.000 |
| −0.915 | 0.106 | 0.000 |
| −0.878 | 0.072 | 0.000 |
| −0.839 | 0.038 | 0.000 |
| −0.797 | 0.004 | 0.000 |
| −0.753 | −0.031 | 0.000 |
| −0.707 | −0.066 | 0.000 |
| −0.658 | −0.102 | 0.000 |
| −0.609 | −0.136 | 0.000 |
| −0.560 | −0.170 | 0.000 |
| −0.509 | −0.202 | 0.000 |
| −0.458 | −0.234 | 0.000 |
| −0.407 | −0.265 | 0.000 |
| −0.355 | −0.296 | 0.000 |
| −0.303 | −0.326 | 0.000 |
| −0.250 | −0.355 | 0.000 |
| −0.198 | −0.384 | 0.000 |
| −0.145 | −0.412 | 0.000 |
| −0.091 | −0.440 | 0.000 |
| −0.039 | −0.466 | 0.000 |
| 0.011 | −0.490 | 0.000 |
| 0.060 | −0.514 | 0.000 |
| 0.107 | −0.536 | 0.000 |
| 0.153 | −0.556 | 0.000 |
| 0.197 | −0.575 | 0.000 |
| 0.239 | −0.593 | 0.000 |
| 0.280 | −0.610 | 0.000 |
| 0.317 | −0.625 | 0.000 |
| 0.351 | −0.638 | 0.000 |
| 0.381 | −0.650 | 0.000 |
| 0.409 | −0.660 | 0.000 |
| 0.434 | −0.669 | 0.000 |
| 0.453 | −0.675 | 0.000 |
| 0.468 | −0.680 | 0.000 |
| 0.479 | −0.684 | 0.000 |
| 0.486 | −0.690 | 0.000 |
| 0.487 | −0.695 | 0.000 |
| 0.488 | −0.698 | 0.000 |
| 0.487 | −0.700 | 0.000 |
| 0.487 | −0.700 | 0.000 |
| 0.487 | −0.701 | 0.000 |
| 0.438 | −0.613 | 0.145 |
| 0.438 | −0.613 | 0.145 |
| 0.437 | −0.615 | 0.145 |
| 0.436 | −0.618 | 0.145 |
| 0.432 | −0.621 | 0.145 |
| 0.423 | −0.622 | 0.145 |
| 0.411 | −0.619 | 0.145 |
| 0.396 | −0.615 | 0.145 |
| 0.377 | −0.610 | 0.145 |
| 0.351 | −0.603 | 0.145 |
| 0.322 | −0.595 | 0.145 |
| 0.291 | −0.588 | 0.145 |
| 0.256 | −0.579 | 0.145 |
| 0.218 | −0.569 | 0.145 |
| 0.175 | −0.558 | 0.145 |
| 0.131 | −0.546 | 0.145 |
| 0.085 | −0.533 | 0.145 |
| 0.036 | −0.519 | 0.145 |
| −0.013 | −0.504 | 0.145 |
| −0.065 | −0.488 | 0.145 |
| −0.118 | −0.470 | 0.145 |
| −0.172 | −0.451 | 0.145 |
| −0.228 | −0.430 | 0.145 |
| −0.284 | −0.408 | 0.145 |
| −0.339 | −0.385 | 0.145 |
| −0.393 | −0.361 | 0.145 |
| −0.447 | −0.335 | 0.145 |
| −0.500 | −0.308 | 0.145 |
| −0.552 | −0.280 | 0.145 |
| −0.604 | −0.249 | 0.145 |
| −0.654 | −0.218 | 0.145 |
| −0.704 | −0.184 | 0.145 |
| −0.753 | −0.148 | 0.145 |
| −0.800 | −0.111 | 0.145 |

TABLE I-continued

| X-LOC | Y-LOC | Z-LOC |
|---|---|---|
| −0.843 | −0.073 | 0.145 |
| −0.884 | −0.035 | 0.145 |
| −0.922 | 0.003 | 0.145 |
| −0.957 | 0.041 | 0.145 |
| −0.990 | 0.079 | 0.145 |
| −1.020 | 0.116 | 0.145 |
| −1.047 | 0.154 | 0.145 |
| −1.070 | 0.189 | 0.145 |
| −1.090 | 0.222 | 0.145 |
| −1.107 | 0.251 | 0.145 |
| −1.121 | 0.278 | 0.145 |
| −1.132 | 0.302 | 0.145 |
| −1.141 | 0.322 | 0.145 |
| −1.148 | 0.340 | 0.145 |
| −1.154 | 0.355 | 0.145 |
| −1.158 | 0.367 | 0.145 |
| −1.160 | 0.377 | 0.145 |
| −1.161 | 0.385 | 0.145 |
| −1.161 | 0.391 | 0.145 |
| −1.160 | 0.396 | 0.145 |
| −1.157 | 0.400 | 0.145 |
| −1.155 | 0.401 | 0.145 |
| −1.152 | 0.402 | 0.145 |
| −1.148 | 0.402 | 0.145 |
| −1.144 | 0.399 | 0.145 |
| −1.140 | 0.396 | 0.145 |
| −1.134 | 0.391 | 0.145 |
| −1.127 | 0.384 | 0.145 |
| −1.118 | 0.375 | 0.145 |
| −1.108 | 0.363 | 0.145 |
| −1.097 | 0.350 | 0.145 |
| −1.083 | 0.334 | 0.145 |
| −1.066 | 0.315 | 0.145 |
| −1.047 | 0.293 | 0.145 |
| −1.025 | 0.270 | 0.145 |
| −1.000 | 0.243 | 0.145 |
| −0.971 | 0.215 | 0.145 |
| −0.940 | 0.184 | 0.145 |
| −0.906 | 0.153 | 0.145 |
| −0.870 | 0.122 | 0.145 |
| −0.831 | 0.090 | 0.145 |
| −0.791 | 0.057 | 0.145 |
| −0.749 | 0.025 | 0.145 |
| −0.704 | −0.008 | 0.145 |
| −0.658 | −0.042 | 0.145 |
| −0.611 | −0.075 | 0.145 |
| −0.563 | −0.107 | 0.145 |
| −0.515 | −0.138 | 0.145 |
| −0.466 | −0.168 | 0.145 |
| −0.417 | −0.198 | 0.145 |
| −0.367 | −0.227 | 0.145 |
| −0.317 | −0.255 | 0.145 |
| −0.267 | −0.282 | 0.145 |
| −0.216 | −0.309 | 0.145 |
| −0.165 | −0.336 | 0.145 |
| −0.114 | −0.362 | 0.145 |
| −0.064 | −0.387 | 0.145 |
| −0.016 | −0.410 | 0.145 |
| 0.031 | −0.432 | 0.145 |
| 0.076 | −0.453 | 0.145 |
| 0.120 | −0.472 | 0.145 |
| 0.162 | −0.491 | 0.145 |
| 0.202 | −0.508 | 0.145 |
| 0.241 | −0.524 | 0.145 |
| 0.277 | −0.539 | 0.145 |
| 0.309 | −0.551 | 0.145 |
| 0.337 | −0.562 | 0.145 |
| 0.364 | −0.572 | 0.145 |
| 0.388 | −0.581 | 0.145 |
| 0.406 | −0.587 | 0.145 |
| 0.420 | −0.592 | 0.145 |
| 0.431 | −0.596 | 0.145 |
| 0.437 | −0.602 | 0.145 |
| 0.439 | −0.607 | 0.145 |
| 0.439 | −0.610 | 0.145 |
| 0.439 | −0.611 | 0.145 |
| 0.439 | −0.612 | 0.145 |

TABLE I-continued

| X-LOC | Y-LOC | Z-LOC |
|---|---|---|
| 0.438 | −0.612 | 0.145 |
| 0.416 | −0.526 | 0.305 |
| 0.416 | −0.527 | 0.305 |
| 0.415 | −0.529 | 0.305 |
| 0.413 | −0.531 | 0.305 |
| 0.409 | −0.534 | 0.305 |
| 0.401 | −0.536 | 0.305 |
| 0.390 | −0.533 | 0.305 |
| 0.375 | −0.528 | 0.305 |
| 0.356 | −0.523 | 0.305 |
| 0.332 | −0.517 | 0.305 |
| 0.304 | −0.509 | 0.305 |
| 0.274 | −0.501 | 0.305 |
| 0.241 | −0.492 | 0.305 |
| 0.203 | −0.482 | 0.305 |
| 0.162 | −0.471 | 0.305 |
| 0.120 | −0.459 | 0.305 |
| 0.075 | −0.446 | 0.305 |
| 0.029 | −0.432 | 0.305 |
| −0.019 | −0.418 | 0.305 |
| −0.069 | −0.402 | 0.305 |
| −0.120 | −0.384 | 0.305 |
| −0.173 | −0.366 | 0.305 |
| −0.227 | −0.346 | 0.305 |
| −0.281 | −0.325 | 0.305 |
| −0.335 | −0.303 | 0.305 |
| −0.388 | −0.280 | 0.305 |
| −0.440 | −0.255 | 0.305 |
| −0.492 | −0.230 | 0.305 |
| −0.543 | −0.203 | 0.305 |
| −0.594 | −0.175 | 0.305 |
| −0.643 | −0.145 | 0.305 |
| −0.692 | −0.114 | 0.305 |
| −0.740 | −0.081 | 0.305 |
| −0.786 | −0.047 | 0.305 |
| −0.830 | −0.012 | 0.305 |
| −0.871 | 0.023 | 0.305 |
| −0.909 | 0.057 | 0.305 |
| −0.944 | 0.092 | 0.305 |
| −0.977 | 0.127 | 0.305 |
| −1.007 | 0.162 | 0.305 |
| −1.035 | 0.196 | 0.305 |
| −1.060 | 0.229 | 0.305 |
| −1.081 | 0.259 | 0.305 |
| −1.099 | 0.286 | 0.305 |
| −1.114 | 0.311 | 0.305 |
| −1.126 | 0.333 | 0.305 |
| −1.136 | 0.352 | 0.305 |
| −1.144 | 0.368 | 0.305 |
| −1.151 | 0.382 | 0.305 |
| −1.155 | 0.394 | 0.305 |
| −1.159 | 0.403 | 0.305 |
| −1.160 | 0.411 | 0.305 |
| −1.161 | 0.417 | 0.305 |
| −1.160 | 0.422 | 0.305 |
| −1.158 | 0.425 | 0.305 |
| −1.156 | 0.427 | 0.305 |
| −1.153 | 0.428 | 0.305 |
| −1.149 | 0.427 | 0.305 |
| −1.145 | 0.425 | 0.305 |
| −1.141 | 0.422 | 0.305 |
| −1.135 | 0.418 | 0.305 |
| −1.127 | 0.411 | 0.305 |
| −1.119 | 0.403 | 0.305 |
| −1.109 | 0.392 | 0.305 |
| −1.096 | 0.380 | 0.305 |
| −1.082 | 0.365 | 0.305 |
| −1.065 | 0.348 | 0.305 |
| −1.045 | 0.328 | 0.305 |
| −1.023 | 0.306 | 0.305 |
| −0.997 | 0.282 | 0.305 |
| −0.968 | 0.255 | 0.305 |
| −0.936 | 0.227 | 0.305 |
| −0.902 | 0.198 | 0.305 |
| −0.866 | 0.169 | 0.305 |
| −0.828 | 0.139 | 0.305 |
| −0.788 | 0.109 | 0.305 |

TABLE I-continued

| X-LOC | Y-LOC | Z-LOC |
|---|---|---|
| −0.745 | 0.078 | 0.305 |
| −0.701 | 0.047 | 0.305 |
| −0.655 | 0.015 | 0.305 |
| −0.609 | −0.016 | 0.305 |
| −0.562 | −0.046 | 0.305 |
| −0.515 | −0.075 | 0.305 |
| −0.467 | −0.104 | 0.305 |
| −0.419 | −0.132 | 0.305 |
| −0.370 | −0.159 | 0.305 |
| −0.321 | −0.186 | 0.305 |
| −0.272 | −0.212 | 0.305 |
| −0.222 | −0.237 | 0.305 |
| −0.172 | −0.262 | 0.305 |
| −0.122 | −0.287 | 0.305 |
| −0.073 | −0.310 | 0.305 |
| −0.026 | −0.332 | 0.305 |
| 0.019 | −0.353 | 0.305 |
| 0.064 | −0.373 | 0.305 |
| 0.106 | −0.392 | 0.305 |
| 0.147 | −0.409 | 0.305 |
| 0.187 | −0.426 | 0.305 |
| 0.225 | −0.441 | 0.305 |
| 0.259 | −0.455 | 0.305 |
| 0.290 | −0.467 | 0.305 |
| 0.318 | −0.478 | 0.305 |
| 0.344 | −0.487 | 0.305 |
| 0.367 | −0.495 | 0.305 |
| 0.385 | −0.501 | 0.305 |
| 0.399 | −0.506 | 0.305 |
| 0.409 | −0.510 | 0.305 |
| 0.415 | −0.516 | 0.305 |
| 0.416 | −0.521 | 0.305 |
| 0.417 | −0.523 | 0.305 |
| 0.416 | −0.525 | 0.305 |
| 0.416 | −0.526 | 0.305 |
| 0.416 | −0.526 | 0.305 |
| 0.416 | −0.476 | 0.432 |
| 0.416 | −0.477 | 0.432 |
| 0.415 | −0.478 | 0.432 |
| 0.413 | −0.480 | 0.432 |
| 0.410 | −0.483 | 0.432 |
| 0.401 | −0.485 | 0.432 |
| 0.390 | −0.482 | 0.432 |
| 0.376 | −0.478 | 0.432 |
| 0.357 | −0.473 | 0.432 |
| 0.333 | −0.466 | 0.432 |
| 0.306 | −0.459 | 0.432 |
| 0.276 | −0.451 | 0.432 |
| 0.243 | −0.442 | 0.432 |
| 0.207 | −0.432 | 0.432 |
| 0.166 | −0.421 | 0.432 |
| 0.124 | −0.410 | 0.432 |
| 0.080 | −0.397 | 0.432 |
| 0.034 | −0.384 | 0.432 |
| −0.013 | −0.369 | 0.432 |
| −0.062 | −0.354 | 0.432 |
| −0.112 | −0.337 | 0.432 |
| −0.164 | −0.320 | 0.432 |
| −0.218 | −0.300 | 0.432 |
| −0.271 | −0.280 | 0.432 |
| −0.323 | −0.259 | 0.432 |
| −0.376 | −0.237 | 0.432 |
| −0.427 | −0.214 | 0.432 |
| −0.479 | −0.190 | 0.432 |
| −0.529 | −0.164 | 0.432 |
| −0.579 | −0.137 | 0.432 |
| −0.629 | −0.108 | 0.432 |
| −0.678 | −0.079 | 0.432 |
| −0.726 | −0.048 | 0.432 |
| −0.773 | −0.015 | 0.432 |
| −0.817 | 0.018 | 0.432 |
| −0.859 | 0.051 | 0.432 |
| −0.898 | 0.084 | 0.432 |
| −0.934 | 0.117 | 0.432 |
| −0.968 | 0.151 | 0.432 |
| −0.999 | 0.184 | 0.432 |
| −1.028 | 0.217 | 0.432 |

TABLE I-continued

| X-LOC | Y-LOC | Z-LOC |
|---|---|---|
| −1.054 | 0.248 | 0.432 |
| −1.076 | 0.277 | 0.432 |
| −1.095 | 0.304 | 0.432 |
| −1.111 | 0.328 | 0.432 |
| −1.124 | 0.349 | 0.432 |
| −1.135 | 0.367 | 0.432 |
| −1.143 | 0.383 | 0.432 |
| −1.150 | 0.396 | 0.432 |
| −1.155 | 0.408 | 0.432 |
| −1.159 | 0.417 | 0.432 |
| −1.161 | 0.424 | 0.432 |
| −1.161 | 0.430 | 0.432 |
| −1.161 | 0.435 | 0.432 |
| −1.159 | 0.438 | 0.432 |
| −1.157 | 0.440 | 0.432 |
| −1.154 | 0.441 | 0.432 |
| −1.150 | 0.441 | 0.432 |
| −1.146 | 0.440 | 0.432 |
| −1.141 | 0.437 | 0.432 |
| −1.135 | 0.433 | 0.432 |
| −1.128 | 0.427 | 0.432 |
| −1.119 | 0.419 | 0.432 |
| −1.108 | 0.410 | 0.432 |
| −1.095 | 0.398 | 0.432 |
| −1.080 | 0.384 | 0.432 |
| −1.062 | 0.368 | 0.432 |
| −1.041 | 0.350 | 0.432 |
| −1.018 | 0.329 | 0.432 |
| −0.991 | 0.306 | 0.432 |
| −0.961 | 0.282 | 0.432 |
| −0.929 | 0.255 | 0.432 |
| −0.894 | 0.228 | 0.432 |
| −0.857 | 0.200 | 0.432 |
| −0.818 | 0.172 | 0.432 |
| −0.778 | 0.143 | 0.432 |
| −0.735 | 0.114 | 0.432 |
| −0.691 | 0.085 | 0.432 |
| −0.645 | 0.054 | 0.432 |
| −0.598 | 0.024 | 0.432 |
| −0.551 | −0.005 | 0.432 |
| −0.504 | −0.033 | 0.432 |
| −0.457 | −0.061 | 0.432 |
| −0.409 | −0.088 | 0.432 |
| −0.361 | −0.115 | 0.432 |
| −0.313 | −0.141 | 0.432 |
| −0.264 | −0.166 | 0.432 |
| −0.215 | −0.191 | 0.432 |
| −0.166 | −0.216 | 0.432 |
| −0.116 | −0.240 | 0.432 |
| −0.068 | −0.263 | 0.432 |
| −0.021 | −0.284 | 0.432 |
| 0.024 | −0.305 | 0.432 |
| 0.068 | −0.324 | 0.432 |
| 0.110 | −0.343 | 0.432 |
| 0.150 | −0.360 | 0.432 |
| 0.189 | −0.376 | 0.432 |
| 0.227 | −0.391 | 0.432 |
| 0.261 | −0.405 | 0.432 |
| 0.292 | −0.417 | 0.432 |
| 0.319 | −0.427 | 0.432 |
| 0.345 | −0.437 | 0.432 |
| 0.368 | −0.445 | 0.432 |
| 0.385 | −0.451 | 0.432 |
| 0.399 | −0.456 | 0.432 |
| 0.410 | −0.460 | 0.432 |
| 0.415 | −0.466 | 0.432 |
| 0.416 | −0.470 | 0.432 |
| 0.416 | −0.473 | 0.432 |
| 0.416 | −0.474 | 0.432 |
| 0.416 | −0.475 | 0.432 |
| 0.416 | −0.475 | 0.432 |
| 0.431 | −0.420 | 0.685 |
| 0.431 | −0.421 | 0.685 |
| 0.431 | −0.422 | 0.685 |
| 0.429 | −0.425 | 0.685 |
| 0.425 | −0.428 | 0.685 |
| 0.417 | −0.430 | 0.685 |

TABLE I-continued

| X-LOC | Y-LOC | Z-LOC |
|---|---|---|
| 0.406 | −0.428 | 0.685 |
| 0.391 | −0.424 | 0.685 |
| 0.373 | −0.420 | 0.685 |
| 0.349 | −0.414 | 0.685 |
| 0.321 | −0.407 | 0.685 |
| 0.292 | −0.401 | 0.685 |
| 0.258 | −0.393 | 0.685 |
| 0.221 | −0.384 | 0.685 |
| 0.181 | −0.374 | 0.685 |
| 0.139 | −0.363 | 0.685 |
| 0.095 | −0.352 | 0.685 |
| 0.049 | −0.339 | 0.685 |
| 0.002 | −0.326 | 0.685 |
| −0.047 | −0.311 | 0.685 |
| −0.098 | −0.295 | 0.685 |
| −0.150 | −0.278 | 0.685 |
| −0.204 | −0.259 | 0.685 |
| −0.257 | −0.239 | 0.685 |
| −0.310 | −0.219 | 0.685 |
| −0.363 | −0.197 | 0.685 |
| −0.415 | −0.174 | 0.685 |
| −0.466 | −0.150 | 0.685 |
| −0.517 | −0.125 | 0.685 |
| −0.568 | −0.099 | 0.685 |
| −0.617 | −0.071 | 0.685 |
| −0.666 | −0.042 | 0.685 |
| −0.714 | −0.013 | 0.685 |
| −0.760 | 0.019 | 0.685 |
| −0.805 | 0.051 | 0.685 |
| −0.846 | 0.083 | 0.685 |
| −0.885 | 0.115 | 0.685 |
| −0.922 | 0.148 | 0.685 |
| −0.956 | 0.181 | 0.685 |
| −0.989 | 0.213 | 0.685 |
| −1.018 | 0.245 | 0.685 |
| −1.045 | 0.275 | 0.685 |
| −1.067 | 0.303 | 0.685 |
| −1.087 | 0.329 | 0.685 |
| −1.104 | 0.352 | 0.685 |
| −1.118 | 0.373 | 0.685 |
| −1.129 | 0.390 | 0.685 |
| −1.138 | 0.406 | 0.685 |
| −1.145 | 0.419 | 0.685 |
| −1.151 | 0.430 | 0.685 |
| −1.154 | 0.439 | 0.685 |
| −1.156 | 0.447 | 0.685 |
| −1.156 | 0.453 | 0.685 |
| −1.155 | 0.457 | 0.685 |
| −1.154 | 0.461 | 0.685 |
| −1.152 | 0.463 | 0.685 |
| −1.149 | 0.464 | 0.685 |
| −1.146 | 0.465 | 0.685 |
| −1.141 | 0.464 | 0.685 |
| −1.136 | 0.463 | 0.685 |
| −1.129 | 0.460 | 0.685 |
| −1.121 | 0.455 | 0.685 |
| −1.111 | 0.449 | 0.685 |
| −1.099 | 0.441 | 0.685 |
| −1.085 | 0.431 | 0.685 |
| −1.068 | 0.420 | 0.685 |
| −1.049 | 0.406 | 0.685 |
| −1.027 | 0.390 | 0.685 |
| −1.002 | 0.371 | 0.685 |
| −0.974 | 0.351 | 0.685 |
| −0.942 | 0.328 | 0.685 |
| −0.908 | 0.304 | 0.685 |
| −0.872 | 0.279 | 0.685 |
| −0.835 | 0.253 | 0.685 |
| −0.796 | 0.226 | 0.685 |
| −0.755 | 0.198 | 0.685 |
| −0.712 | 0.170 | 0.685 |
| −0.668 | 0.141 | 0.685 |
| −0.622 | 0.112 | 0.685 |
| −0.575 | 0.082 | 0.685 |
| −0.529 | 0.054 | 0.685 |
| −0.482 | 0.025 | 0.685 |
| −0.434 | −0.002 | 0.685 |

TABLE I-continued

| X-LOC | Y-LOC | Z-LOC |
|---|---|---|
| −0.387 | −0.030 | 0.685 |
| −0.339 | −0.057 | 0.685 |
| −0.291 | −0.083 | 0.685 |
| −0.243 | −0.109 | 0.685 |
| −0.194 | −0.135 | 0.685 |
| −0.146 | −0.160 | 0.685 |
| −0.097 | −0.184 | 0.685 |
| −0.049 | −0.208 | 0.685 |
| −0.003 | −0.230 | 0.685 |
| 0.042 | −0.251 | 0.685 |
| 0.085 | −0.271 | 0.685 |
| 0.127 | −0.289 | 0.685 |
| 0.167 | −0.307 | 0.685 |
| 0.206 | −0.323 | 0.685 |
| 0.243 | −0.338 | 0.685 |
| 0.277 | −0.352 | 0.685 |
| 0.307 | −0.364 | 0.685 |
| 0.335 | −0.374 | 0.685 |
| 0.361 | −0.383 | 0.685 |
| 0.383 | −0.390 | 0.685 |
| 0.401 | −0.396 | 0.685 |
| 0.415 | −0.400 | 0.685 |
| 0.425 | −0.404 | 0.685 |
| 0.431 | −0.410 | 0.685 |
| 0.432 | −0.414 | 0.685 |
| 0.432 | −0.417 | 0.685 |
| 0.432 | −0.419 | 0.685 |
| 0.432 | −0.419 | 0.685 |
| 0.432 | −0.420 | 0.685 |
| 0.440 | −0.415 | 0.939 |
| 0.439 | −0.416 | 0.939 |
| 0.439 | −0.417 | 0.939 |
| 0.437 | −0.420 | 0.939 |
| 0.434 | −0.423 | 0.939 |
| 0.425 | −0.426 | 0.939 |
| 0.414 | −0.423 | 0.939 |
| 0.399 | −0.420 | 0.939 |
| 0.380 | −0.416 | 0.939 |
| 0.356 | −0.410 | 0.939 |
| 0.328 | −0.404 | 0.939 |
| 0.298 | −0.397 | 0.939 |
| 0.264 | −0.389 | 0.939 |
| 0.227 | −0.380 | 0.939 |
| 0.186 | −0.370 | 0.939 |
| 0.143 | −0.358 | 0.939 |
| 0.099 | −0.346 | 0.939 |
| 0.053 | −0.333 | 0.939 |
| 0.005 | −0.318 | 0.939 |
| −0.044 | −0.302 | 0.939 |
| −0.095 | −0.284 | 0.939 |
| −0.147 | −0.265 | 0.939 |
| −0.201 | −0.245 | 0.939 |
| −0.254 | −0.223 | 0.939 |
| −0.307 | −0.200 | 0.939 |
| −0.360 | −0.177 | 0.939 |
| −0.411 | −0.152 | 0.939 |
| −0.463 | −0.126 | 0.939 |
| −0.513 | −0.099 | 0.939 |
| −0.563 | −0.071 | 0.939 |
| −0.613 | −0.041 | 0.939 |
| −0.661 | −0.011 | 0.939 |
| −0.709 | 0.021 | 0.939 |
| −0.757 | 0.054 | 0.939 |
| −0.801 | 0.087 | 0.939 |
| −0.843 | 0.120 | 0.939 |
| −0.883 | 0.154 | 0.939 |
| −0.920 | 0.187 | 0.939 |
| −0.955 | 0.219 | 0.939 |
| −0.988 | 0.252 | 0.939 |
| −1.018 | 0.283 | 0.939 |
| −1.046 | 0.313 | 0.939 |
| −1.070 | 0.341 | 0.939 |
| −1.090 | 0.366 | 0.939 |
| −1.108 | 0.388 | 0.939 |
| −1.123 | 0.408 | 0.939 |
| −1.136 | 0.425 | 0.939 |
| −1.146 | 0.440 | 0.939 |

TABLE I-continued

| X-LOC | Y-LOC | Z-LOC |
|---|---|---|
| −1.155 | 0.453 | 0.939 |
| −1.161 | 0.463 | 0.939 |
| −1.166 | 0.472 | 0.939 |
| −1.169 | 0.479 | 0.939 |
| −1.170 | 0.485 | 0.939 |
| −1.170 | 0.490 | 0.939 |
| −1.168 | 0.493 | 0.939 |
| −1.167 | 0.496 | 0.939 |
| −1.164 | 0.497 | 0.939 |
| −1.160 | 0.497 | 0.939 |
| −1.156 | 0.496 | 0.939 |
| −1.151 | 0.494 | 0.939 |
| −1.144 | 0.490 | 0.939 |
| −1.136 | 0.485 | 0.939 |
| −1.126 | 0.478 | 0.939 |
| −1.114 | 0.469 | 0.939 |
| −1.100 | 0.459 | 0.939 |
| −1.084 | 0.446 | 0.939 |
| −1.065 | 0.431 | 0.939 |
| −1.043 | 0.414 | 0.939 |
| −1.018 | 0.394 | 0.939 |
| −0.990 | 0.372 | 0.939 |
| −0.959 | 0.348 | 0.939 |
| −0.925 | 0.322 | 0.939 |
| −0.890 | 0.295 | 0.939 |
| −0.852 | 0.267 | 0.939 |
| −0.813 | 0.238 | 0.939 |
| −0.773 | 0.208 | 0.939 |
| −0.730 | 0.178 | 0.939 |
| −0.685 | 0.147 | 0.939 |
| −0.639 | 0.115 | 0.939 |
| −0.593 | 0.084 | 0.939 |
| −0.546 | 0.054 | 0.939 |
| −0.498 | 0.024 | 0.939 |
| −0.451 | −0.005 | 0.939 |
| −0.403 | −0.034 | 0.939 |
| −0.354 | −0.061 | 0.939 |
| −0.305 | −0.089 | 0.939 |
| −0.256 | −0.115 | 0.939 |
| −0.207 | −0.141 | 0.939 |
| −0.157 | −0.167 | 0.939 |
| −0.107 | −0.191 | 0.939 |
| −0.058 | −0.214 | 0.939 |
| −0.010 | −0.236 | 0.939 |
| 0.036 | −0.257 | 0.939 |
| 0.080 | −0.276 | 0.939 |
| 0.124 | −0.293 | 0.939 |
| 0.165 | −0.310 | 0.939 |
| 0.205 | −0.325 | 0.939 |
| 0.244 | −0.339 | 0.939 |
| 0.279 | −0.351 | 0.939 |
| 0.311 | −0.362 | 0.939 |
| 0.339 | −0.371 | 0.939 |
| 0.366 | −0.379 | 0.939 |
| 0.390 | −0.386 | 0.939 |
| 0.407 | −0.391 | 0.939 |
| 0.422 | −0.395 | 0.939 |
| 0.433 | −0.399 | 0.939 |
| 0.438 | −0.404 | 0.939 |
| 0.440 | −0.409 | 0.939 |
| 0.440 | −0.412 | 0.939 |
| 0.440 | −0.413 | 0.939 |
| 0.440 | −0.414 | 0.939 |
| 0.440 | −0.415 | 0.939 |
| 0.443 | −0.437 | 1.066 |
| 0.443 | −0.438 | 1.066 |
| 0.442 | −0.440 | 1.066 |
| 0.441 | −0.442 | 1.066 |
| 0.437 | −0.446 | 1.066 |
| 0.429 | −0.448 | 1.066 |
| 0.417 | −0.446 | 1.066 |
| 0.402 | −0.443 | 1.066 |
| 0.383 | −0.438 | 1.066 |
| 0.359 | −0.433 | 1.066 |
| 0.330 | −0.426 | 1.066 |
| 0.300 | −0.419 | 1.066 |
| 0.266 | −0.411 | 1.066 |

TABLE I-continued

| X-LOC | Y-LOC | Z-LOC |
|---|---|---|
| 0.228 | −0.401 | 1.066 |
| 0.187 | −0.390 | 1.066 |
| 0.143 | −0.378 | 1.066 |
| 0.099 | −0.365 | 1.066 |
| 0.052 | −0.350 | 1.066 |
| 0.004 | −0.335 | 1.066 |
| −0.046 | −0.317 | 1.066 |
| −0.097 | −0.298 | 1.066 |
| −0.149 | −0.278 | 1.066 |
| −0.203 | −0.256 | 1.066 |
| −0.257 | −0.232 | 1.066 |
| −0.310 | −0.208 | 1.066 |
| −0.362 | −0.182 | 1.066 |
| −0.414 | −0.156 | 1.066 |
| −0.466 | −0.128 | 1.066 |
| −0.516 | −0.099 | 1.066 |
| −0.566 | −0.069 | 1.066 |
| −0.615 | −0.038 | 1.066 |
| −0.664 | −0.006 | 1.066 |
| −0.712 | 0.027 | 1.066 |
| −0.759 | 0.062 | 1.066 |
| −0.803 | 0.097 | 1.066 |
| −0.845 | 0.132 | 1.066 |
| −0.884 | 0.166 | 1.066 |
| −0.922 | 0.200 | 1.066 |
| −0.957 | 0.234 | 1.066 |
| −0.989 | 0.267 | 1.066 |
| −1.020 | 0.300 | 1.066 |
| −1.047 | 0.331 | 1.066 |
| −1.071 | 0.359 | 1.066 |
| −1.092 | 0.384 | 1.066 |
| −1.110 | 0.407 | 1.066 |
| −1.125 | 0.427 | 1.066 |
| −1.138 | 0.445 | 1.066 |
| −1.148 | 0.460 | 1.066 |
| −1.157 | 0.473 | 1.066 |
| −1.164 | 0.484 | 1.066 |
| −1.169 | 0.492 | 1.066 |
| −1.172 | 0.500 | 1.066 |
| −1.173 | 0.505 | 1.066 |
| −1.173 | 0.510 | 1.066 |
| −1.172 | 0.514 | 1.066 |
| −1.170 | 0.516 | 1.066 |
| −1.168 | 0.517 | 1.066 |
| −1.164 | 0.517 | 1.066 |
| −1.160 | 0.516 | 1.066 |
| −1.155 | 0.513 | 1.066 |
| −1.148 | 0.509 | 1.066 |
| −1.140 | 0.503 | 1.066 |
| −1.131 | 0.495 | 1.066 |
| −1.119 | 0.485 | 1.066 |
| −1.106 | 0.474 | 1.066 |
| −1.090 | 0.460 | 1.066 |
| −1.071 | 0.444 | 1.066 |
| −1.049 | 0.426 | 1.066 |
| −1.025 | 0.405 | 1.066 |
| −0.997 | 0.381 | 1.066 |
| −0.967 | 0.356 | 1.066 |
| −0.933 | 0.328 | 1.066 |
| −0.898 | 0.299 | 1.066 |
| −0.861 | 0.269 | 1.066 |
| −0.822 | 0.239 | 1.066 |
| −0.782 | 0.207 | 1.066 |
| −0.739 | 0.175 | 1.066 |
| −0.695 | 0.143 | 1.066 |
| −0.649 | 0.109 | 1.066 |
| −0.602 | 0.077 | 1.066 |
| −0.555 | 0.045 | 1.066 |
| −0.508 | 0.013 | 1.066 |
| −0.460 | −0.017 | 1.066 |
| −0.412 | −0.047 | 1.066 |
| −0.363 | −0.077 | 1.066 |
| −0.314 | −0.105 | 1.066 |
| −0.264 | −0.133 | 1.066 |
| −0.214 | −0.160 | 1.066 |
| −0.164 | −0.186 | 1.066 |
| −0.113 | −0.211 | 1.066 |

TABLE I-continued

| X-LOC | Y-LOC | Z-LOC |
|---|---|---|
| −0.063 | −0.235 | 1.066 |
| −0.015 | −0.258 | 1.066 |
| 0.032 | −0.279 | 1.066 |
| 0.077 | −0.298 | 1.066 |
| 0.121 | −0.316 | 1.066 |
| 0.163 | −0.333 | 1.066 |
| 0.204 | −0.348 | 1.066 |
| 0.243 | −0.362 | 1.066 |
| 0.279 | −0.374 | 1.066 |
| 0.312 | −0.385 | 1.066 |
| 0.341 | −0.394 | 1.066 |
| 0.368 | −0.402 | 1.066 |
| 0.392 | −0.409 | 1.066 |
| 0.410 | −0.414 | 1.066 |
| 0.425 | −0.418 | 1.066 |
| 0.436 | −0.421 | 1.066 |
| 0.442 | −0.427 | 1.066 |
| 0.443 | −0.431 | 1.066 |
| 0.444 | −0.434 | 1.066 |
| 0.443 | −0.436 | 1.066 |
| 0.443 | −0.437 | 1.066 |
| 0.443 | −0.437 | 1.066 |
| 0.445 | −0.476 | 1.193 |
| 0.445 | −0.477 | 1.193 |
| 0.444 | −0.478 | 1.193 |
| 0.443 | −0.481 | 1.193 |
| 0.439 | −0.484 | 1.193 |
| 0.430 | −0.487 | 1.193 |
| 0.419 | −0.484 | 1.193 |
| 0.403 | −0.481 | 1.193 |
| 0.384 | −0.477 | 1.193 |
| 0.359 | −0.471 | 1.193 |
| 0.330 | −0.464 | 1.193 |
| 0.299 | −0.457 | 1.193 |
| 0.265 | −0.448 | 1.193 |
| 0.226 | −0.439 | 1.193 |
| 0.184 | −0.427 | 1.193 |
| 0.141 | −0.414 | 1.193 |
| 0.096 | −0.400 | 1.193 |
| 0.049 | −0.385 | 1.193 |
| 0.000 | −0.368 | 1.193 |
| −0.050 | −0.350 | 1.193 |
| −0.102 | −0.330 | 1.193 |
| −0.154 | −0.308 | 1.193 |
| −0.209 | −0.284 | 1.193 |
| −0.262 | −0.259 | 1.193 |
| −0.315 | −0.233 | 1.193 |
| −0.368 | −0.206 | 1.193 |
| −0.419 | −0.177 | 1.193 |
| −0.470 | −0.148 | 1.193 |
| −0.520 | −0.117 | 1.193 |
| −0.570 | −0.085 | 1.193 |
| −0.618 | −0.052 | 1.193 |
| −0.666 | −0.018 | 1.193 |
| −0.713 | 0.017 | 1.193 |
| −0.760 | 0.054 | 1.193 |
| −0.803 | 0.091 | 1.193 |
| −0.845 | 0.128 | 1.193 |
| −0.884 | 0.164 | 1.193 |
| −0.920 | 0.200 | 1.193 |
| −0.954 | 0.236 | 1.193 |
| −0.987 | 0.271 | 1.193 |
| −1.017 | 0.305 | 1.193 |
| −1.043 | 0.337 | 1.193 |
| −1.067 | 0.366 | 1.193 |
| −1.087 | 0.393 | 1.193 |
| −1.105 | 0.417 | 1.193 |
| −1.120 | 0.438 | 1.193 |
| −1.132 | 0.456 | 1.193 |
| −1.142 | 0.471 | 1.193 |
| −1.150 | 0.484 | 1.193 |
| −1.157 | 0.496 | 1.193 |
| −1.162 | 0.505 | 1.193 |
| −1.165 | 0.512 | 1.193 |
| −1.166 | 0.518 | 1.193 |
| −1.167 | 0.523 | 1.193 |
| −1.165 | 0.526 | 1.193 |

TABLE I-continued

| X-LOC | Y-LOC | Z-LOC |
|---|---|---|
| −1.164 | 0.529 | 1.193 |
| −1.161 | 0.530 | 1.193 |
| −1.157 | 0.529 | 1.193 |
| −1.153 | 0.527 | 1.193 |
| −1.148 | 0.524 | 1.193 |
| −1.142 | 0.520 | 1.193 |
| −1.134 | 0.513 | 1.193 |
| −1.125 | 0.505 | 1.193 |
| −1.114 | 0.494 | 1.193 |
| −1.100 | 0.482 | 1.193 |
| −1.085 | 0.467 | 1.193 |
| −1.067 | 0.450 | 1.193 |
| −1.046 | 0.430 | 1.193 |
| −1.022 | 0.408 | 1.193 |
| −0.995 | 0.383 | 1.193 |
| −0.966 | 0.355 | 1.193 |
| −0.933 | 0.326 | 1.193 |
| −0.898 | 0.295 | 1.193 |
| −0.862 | 0.264 | 1.193 |
| −0.824 | 0.231 | 1.193 |
| −0.784 | 0.198 | 1.193 |
| −0.742 | 0.164 | 1.193 |
| −0.699 | 0.129 | 1.193 |
| −0.653 | 0.094 | 1.193 |
| −0.607 | 0.059 | 1.193 |
| −0.561 | 0.025 | 1.193 |
| −0.513 | −0.008 | 1.193 |
| −0.466 | −0.040 | 1.193 |
| −0.417 | −0.072 | 1.193 |
| −0.369 | −0.103 | 1.193 |
| −0.319 | −0.133 | 1.193 |
| −0.270 | −0.162 | 1.193 |
| −0.220 | −0.190 | 1.193 |
| −0.169 | −0.218 | 1.193 |
| −0.118 | −0.245 | 1.193 |
| −0.068 | −0.269 | 1.193 |
| −0.020 | −0.293 | 1.193 |
| 0.028 | −0.314 | 1.193 |
| 0.074 | −0.334 | 1.193 |
| 0.118 | −0.353 | 1.193 |
| 0.161 | −0.370 | 1.193 |
| 0.202 | −0.386 | 1.193 |
| 0.242 | −0.400 | 1.193 |
| 0.278 | −0.413 | 1.193 |
| 0.311 | −0.423 | 1.193 |
| 0.341 | −0.433 | 1.193 |
| 0.368 | −0.441 | 1.193 |
| 0.393 | −0.447 | 1.193 |
| 0.411 | −0.452 | 1.193 |
| 0.426 | −0.456 | 1.193 |
| 0.437 | −0.459 | 1.193 |
| 0.444 | −0.465 | 1.193 |
| 0.445 | −0.470 | 1.193 |
| 0.445 | −0.473 | 1.193 |
| 0.445 | −0.474 | 1.193 |
| 0.445 | −0.475 | 1.193 |
| 0.445 | −0.476 | 1.193 |
| 0.444 | −0.526 | 1.320 |
| 0.444 | −0.526 | 1.320 |
| 0.443 | −0.528 | 1.320 |
| 0.441 | −0.531 | 1.320 |
| 0.438 | −0.534 | 1.320 |
| 0.429 | −0.536 | 1.320 |
| 0.417 | −0.534 | 1.320 |
| 0.402 | −0.531 | 1.320 |
| 0.382 | −0.526 | 1.320 |
| 0.357 | −0.521 | 1.320 |
| 0.327 | −0.514 | 1.320 |
| 0.296 | −0.507 | 1.320 |
| 0.261 | −0.498 | 1.320 |
| 0.223 | −0.488 | 1.320 |
| 0.180 | −0.476 | 1.320 |
| 0.136 | −0.463 | 1.320 |
| 0.090 | −0.449 | 1.320 |
| 0.043 | −0.433 | 1.320 |
| −0.006 | −0.415 | 1.320 |
| −0.056 | −0.396 | 1.320 |

TABLE I-continued

| X-LOC | Y-LOC | Z-LOC |
|---|---|---|
| −0.108 | −0.375 | 1.320 |
| −0.161 | −0.352 | 1.320 |
| −0.216 | −0.327 | 1.320 |
| −0.270 | −0.300 | 1.320 |
| −0.323 | −0.273 | 1.320 |
| −0.375 | −0.244 | 1.320 |
| −0.426 | −0.214 | 1.320 |
| −0.477 | −0.183 | 1.320 |
| −0.527 | −0.150 | 1.320 |
| −0.575 | −0.116 | 1.320 |
| −0.623 | −0.081 | 1.320 |
| −0.671 | −0.045 | 1.320 |
| −0.717 | −0.007 | 1.320 |
| −0.762 | 0.032 | 1.320 |
| −0.805 | 0.071 | 1.320 |
| −0.845 | 0.110 | 1.320 |
| −0.883 | 0.148 | 1.320 |
| −0.918 | 0.186 | 1.320 |
| −0.952 | 0.223 | 1.320 |
| −0.982 | 0.260 | 1.320 |
| −1.011 | 0.296 | 1.320 |
| −1.037 | 0.329 | 1.320 |
| −1.060 | 0.360 | 1.320 |
| −1.079 | 0.388 | 1.320 |
| −1.096 | 0.412 | 1.320 |
| −1.110 | 0.434 | 1.320 |
| −1.122 | 0.453 | 1.320 |
| −1.131 | 0.469 | 1.320 |
| −1.139 | 0.483 | 1.320 |
| −1.145 | 0.494 | 1.320 |
| −1.150 | 0.504 | 1.320 |
| −1.153 | 0.511 | 1.320 |
| −1.154 | 0.517 | 1.320 |
| −1.154 | 0.522 | 1.320 |
| −1.153 | 0.526 | 1.320 |
| −1.151 | 0.528 | 1.320 |
| −1.149 | 0.529 | 1.320 |
| −1.145 | 0.528 | 1.320 |
| −1.140 | 0.526 | 1.320 |
| −1.136 | 0.523 | 1.320 |
| −1.130 | 0.517 | 1.320 |
| −1.122 | 0.511 | 1.320 |
| −1.114 | 0.502 | 1.320 |
| −1.103 | 0.491 | 1.320 |
| −1.090 | 0.477 | 1.320 |
| −1.075 | 0.462 | 1.320 |
| −1.058 | 0.444 | 1.320 |
| −1.038 | 0.423 | 1.320 |
| −1.015 | 0.399 | 1.320 |
| −0.989 | 0.372 | 1.320 |
| −0.960 | 0.343 | 1.320 |
| −0.929 | 0.312 | 1.320 |
| −0.895 | 0.279 | 1.320 |
| −0.860 | 0.246 | 1.320 |
| −0.823 | 0.211 | 1.320 |
| −0.784 | 0.176 | 1.320 |
| −0.743 | 0.140 | 1.320 |
| −0.700 | 0.104 | 1.320 |
| −0.655 | 0.067 | 1.320 |
| −0.610 | 0.030 | 1.320 |
| −0.564 | −0.006 | 1.320 |
| −0.518 | −0.041 | 1.320 |
| −0.470 | −0.075 | 1.320 |
| −0.423 | −0.108 | 1.320 |
| −0.374 | −0.141 | 1.320 |
| −0.325 | −0.172 | 1.320 |
| −0.275 | −0.203 | 1.320 |
| −0.225 | −0.232 | 1.320 |
| −0.175 | −0.261 | 1.320 |
| −0.123 | −0.289 | 1.320 |
| −0.074 | −0.315 | 1.320 |
| −0.025 | −0.339 | 1.320 |
| 0.023 | −0.361 | 1.320 |
| 0.069 | −0.382 | 1.320 |
| 0.113 | −0.401 | 1.320 |
| 0.157 | −0.418 | 1.320 |
| 0.198 | −0.435 | 1.320 |

TABLE I-continued

| X-LOC | Y-LOC | Z-LOC |
|---|---|---|
| 0.239 | −0.449 | 1.320 |
| 0.275 | −0.462 | 1.320 |
| 0.309 | −0.473 | 1.320 |
| 0.338 | −0.482 | 1.320 |
| 0.366 | −0.490 | 1.320 |
| 0.391 | −0.497 | 1.320 |
| 0.410 | −0.502 | 1.320 |
| 0.425 | −0.506 | 1.320 |
| 0.436 | −0.509 | 1.320 |
| 0.442 | −0.515 | 1.320 |
| 0.444 | −0.519 | 1.320 |
| 0.444 | −0.522 | 1.320 |
| 0.444 | −0.524 | 1.320 |
| 0.444 | −0.525 | 1.320 |
| 0.444 | −0.525 | 1.320 |
| 0.439 | −0.568 | 1.423 |
| 0.439 | −0.568 | 1.423 |
| 0.438 | −0.570 | 1.423 |
| 0.437 | −0.573 | 1.423 |
| 0.433 | −0.576 | 1.423 |
| 0.424 | −0.578 | 1.423 |
| 0.412 | −0.576 | 1.423 |
| 0.396 | −0.573 | 1.423 |
| 0.377 | −0.568 | 1.423 |
| 0.351 | −0.563 | 1.423 |
| 0.322 | −0.556 | 1.423 |
| 0.290 | −0.548 | 1.423 |
| 0.255 | −0.540 | 1.423 |
| 0.216 | −0.529 | 1.423 |
| 0.174 | −0.517 | 1.423 |
| 0.129 | −0.504 | 1.423 |
| 0.083 | −0.489 | 1.423 |
| 0.036 | −0.473 | 1.423 |
| −0.013 | −0.455 | 1.423 |
| −0.064 | −0.435 | 1.423 |
| −0.116 | −0.413 | 1.423 |
| −0.169 | −0.389 | 1.423 |
| −0.224 | −0.364 | 1.423 |
| −0.278 | −0.336 | 1.423 |
| −0.331 | −0.308 | 1.423 |
| −0.383 | −0.278 | 1.423 |
| −0.434 | −0.246 | 1.423 |
| −0.484 | −0.214 | 1.423 |
| −0.533 | −0.180 | 1.423 |
| −0.581 | −0.145 | 1.423 |
| −0.629 | −0.108 | 1.423 |
| −0.675 | −0.070 | 1.423 |
| −0.720 | −0.031 | 1.423 |
| −0.765 | 0.009 | 1.423 |
| −0.806 | 0.050 | 1.423 |
| −0.846 | 0.091 | 1.423 |
| −0.883 | 0.130 | 1.423 |
| −0.917 | 0.170 | 1.423 |
| −0.949 | 0.208 | 1.423 |
| −0.979 | 0.246 | 1.423 |
| −1.007 | 0.283 | 1.423 |
| −1.032 | 0.318 | 1.423 |
| −1.053 | 0.349 | 1.423 |
| −1.072 | 0.378 | 1.423 |
| −1.088 | 0.403 | 1.423 |
| −1.102 | 0.426 | 1.423 |
| −1.113 | 0.445 | 1.423 |
| −1.122 | 0.461 | 1.423 |
| −1.130 | 0.475 | 1.423 |
| −1.136 | 0.487 | 1.423 |
| −1.140 | 0.497 | 1.423 |
| −1.143 | 0.504 | 1.423 |
| −1.144 | 0.510 | 1.423 |
| −1.144 | 0.515 | 1.423 |
| −1.143 | 0.519 | 1.423 |
| −1.141 | 0.522 | 1.423 |
| −1.138 | 0.522 | 1.423 |
| −1.134 | 0.521 | 1.423 |
| −1.130 | 0.518 | 1.423 |
| −1.126 | 0.515 | 1.423 |
| −1.120 | 0.509 | 1.423 |
| −1.113 | 0.502 | 1.423 |

TABLE I-continued

| X-LOC | Y-LOC | Z-LOC |
|---|---|---|
| −1.104 | 0.493 | 1.423 |
| −1.094 | 0.481 | 1.423 |
| −1.082 | 0.467 | 1.423 |
| −1.068 | 0.451 | 1.423 |
| −1.051 | 0.432 | 1.423 |
| −1.031 | 0.410 | 1.423 |
| −1.009 | 0.385 | 1.423 |
| −0.984 | 0.357 | 1.423 |
| −0.956 | 0.327 | 1.423 |
| −0.926 | 0.294 | 1.423 |
| −0.893 | 0.260 | 1.423 |
| −0.859 | 0.225 | 1.423 |
| −0.822 | 0.189 | 1.423 |
| −0.784 | 0.153 | 1.423 |
| −0.744 | 0.115 | 1.423 |
| −0.702 | 0.077 | 1.423 |
| −0.657 | 0.039 | 1.423 |
| −0.613 | 0.001 | 1.423 |
| −0.568 | −0.036 | 1.423 |
| −0.522 | −0.072 | 1.423 |
| −0.475 | −0.107 | 1.423 |
| −0.428 | −0.142 | 1.423 |
| −0.380 | −0.175 | 1.423 |
| −0.332 | −0.207 | 1.423 |
| −0.283 | −0.238 | 1.423 |
| −0.233 | −0.268 | 1.423 |
| −0.183 | −0.298 | 1.423 |
| −0.132 | −0.326 | 1.423 |
| −0.082 | −0.352 | 1.423 |
| −0.033 | −0.377 | 1.423 |
| 0.014 | −0.400 | 1.423 |
| 0.061 | −0.421 | 1.423 |
| 0.106 | −0.441 | 1.423 |
| 0.149 | −0.459 | 1.423 |
| 0.191 | −0.475 | 1.423 |
| 0.232 | −0.490 | 1.423 |
| 0.269 | −0.503 | 1.423 |
| 0.302 | −0.514 | 1.423 |
| 0.332 | −0.524 | 1.423 |
| 0.361 | −0.532 | 1.423 |
| 0.385 | −0.539 | 1.423 |
| 0.404 | −0.544 | 1.423 |
| 0.420 | −0.548 | 1.423 |
| 0.431 | −0.551 | 1.423 |
| 0.438 | −0.557 | 1.423 |
| 0.439 | −0.561 | 1.423 |
| 0.440 | −0.564 | 1.423 |
| 0.439 | −0.566 | 1.423 |
| 0.439 | −0.567 | 1.423 |
| 0.439 | −0.567 | 1.423 |
| 0.434 | −0.611 | 1.524 |
| 0.433 | −0.612 | 1.524 |
| 0.433 | −0.613 | 1.524 |
| 0.431 | −0.616 | 1.524 |
| 0.427 | −0.619 | 1.524 |
| 0.419 | −0.622 | 1.524 |
| 0.407 | −0.620 | 1.524 |
| 0.391 | −0.616 | 1.524 |
| 0.371 | −0.612 | 1.524 |
| 0.346 | −0.606 | 1.524 |
| 0.316 | −0.599 | 1.524 |
| 0.285 | −0.592 | 1.524 |
| 0.249 | −0.583 | 1.524 |
| 0.210 | −0.572 | 1.524 |
| 0.167 | −0.560 | 1.524 |
| 0.123 | −0.546 | 1.524 |
| 0.076 | −0.531 | 1.524 |
| 0.029 | −0.514 | 1.524 |
| −0.021 | −0.496 | 1.524 |
| −0.071 | −0.476 | 1.524 |
| −0.124 | −0.454 | 1.524 |
| −0.177 | −0.429 | 1.524 |
| −0.231 | −0.403 | 1.524 |
| −0.285 | −0.375 | 1.524 |
| −0.337 | −0.346 | 1.524 |
| −0.389 | −0.315 | 1.524 |
| −0.440 | −0.283 | 1.524 |

TABLE I-continued

| X-LOC | Y-LOC | Z-LOC |
|---|---|---|
| −0.490 | −0.250 | 1.524 |
| −0.538 | −0.215 | 1.524 |
| −0.586 | −0.179 | 1.524 |
| −0.633 | −0.141 | 1.524 |
| −0.679 | −0.101 | 1.524 |
| −0.724 | −0.060 | 1.524 |
| −0.768 | −0.018 | 1.524 |
| −0.808 | 0.024 | 1.524 |
| −0.846 | 0.065 | 1.524 |
| −0.882 | 0.106 | 1.524 |
| −0.915 | 0.147 | 1.524 |
| −0.946 | 0.187 | 1.524 |
| −0.974 | 0.226 | 1.524 |
| −1.001 | 0.264 | 1.524 |
| −1.024 | 0.299 | 1.524 |
| −1.045 | 0.331 | 1.524 |
| −1.063 | 0.361 | 1.524 |
| −1.078 | 0.387 | 1.524 |
| −1.091 | 0.410 | 1.524 |
| −1.101 | 0.430 | 1.524 |
| −1.110 | 0.447 | 1.524 |
| −1.117 | 0.461 | 1.524 |
| −1.122 | 0.473 | 1.524 |
| −1.126 | 0.483 | 1.524 |
| −1.129 | 0.491 | 1.524 |
| −1.130 | 0.497 | 1.524 |
| −1.130 | 0.502 | 1.524 |
| −1.129 | 0.506 | 1.524 |
| −1.127 | 0.508 | 1.524 |
| −1.124 | 0.509 | 1.524 |
| −1.120 | 0.507 | 1.524 |
| −1.116 | 0.504 | 1.524 |
| −1.112 | 0.500 | 1.524 |
| −1.106 | 0.495 | 1.524 |
| −1.100 | 0.487 | 1.524 |
| −1.091 | 0.477 | 1.524 |
| −1.082 | 0.465 | 1.524 |
| −1.070 | 0.451 | 1.524 |
| −1.057 | 0.434 | 1.524 |
| −1.041 | 0.414 | 1.524 |
| −1.022 | 0.391 | 1.524 |
| −1.001 | 0.365 | 1.524 |
| −0.977 | 0.337 | 1.524 |
| −0.950 | 0.305 | 1.524 |
| −0.920 | 0.271 | 1.524 |
| −0.889 | 0.236 | 1.524 |
| −0.856 | 0.200 | 1.524 |
| −0.820 | 0.163 | 1.524 |
| −0.783 | 0.125 | 1.524 |
| −0.744 | 0.086 | 1.524 |
| −0.703 | 0.047 | 1.524 |
| −0.659 | 0.007 | 1.524 |
| −0.615 | −0.032 | 1.524 |
| −0.571 | −0.070 | 1.524 |
| −0.525 | −0.107 | 1.524 |
| −0.479 | −0.143 | 1.524 |
| −0.432 | −0.178 | 1.524 |
| −0.385 | −0.211 | 1.524 |
| −0.337 | −0.244 | 1.524 |
| −0.288 | −0.276 | 1.524 |
| −0.239 | −0.307 | 1.524 |
| −0.188 | −0.337 | 1.524 |
| −0.137 | −0.365 | 1.524 |
| −0.088 | −0.392 | 1.524 |
| −0.039 | −0.417 | 1.524 |
| 0.009 | −0.441 | 1.524 |
| 0.055 | −0.462 | 1.524 |
| 0.100 | −0.482 | 1.524 |
| 0.144 | −0.500 | 1.524 |
| 0.186 | −0.517 | 1.524 |
| 0.226 | −0.532 | 1.524 |
| 0.263 | −0.545 | 1.524 |
| 0.297 | −0.557 | 1.524 |
| 0.327 | −0.566 | 1.524 |
| 0.355 | −0.575 | 1.524 |
| 0.380 | −0.582 | 1.524 |
| 0.399 | −0.587 | 1.524 |

TABLE I-continued

| X-LOC | Y-LOC | Z-LOC |
|---|---|---|
| 0.414 | −0.591 | 1.524 |
| 0.425 | −0.594 | 1.524 |
| 0.432 | −0.600 | 1.524 |
| 0.434 | −0.605 | 1.524 |
| 0.434 | −0.608 | 1.524 |
| 0.434 | −0.609 | 1.524 |
| 0.434 | −0.610 | 1.524 |
| 0.434 | −0.611 | 1.524 |

It will also be appreciated that the airfoil disclosed in the above table may be scaled up or down geometrically for use in other similar compressor designs. Consequently, the coordinate values set forth in Table I may be scaled upwardly or downwardly such that the airfoil profile shape remains unchanged. A scaled version of the coordinates in Table I would be represented by X, Y and Z coordinate values multiplied or divided by the same constant or number.

While the invention has been described in connection with what is presently considered to be the most practical and preferred embodiment(s), it is to be understood that the invention is not to be limited to the disclosed embodiment, but on the contrary, is intended to cover various modifications and equivalent arrangements included within the spirit and scope of the appended claims.

What is claimed is:

1. A stator blade for a compressor having an airfoil, the airfoil having an uncoated nominal profile substantially in accordance with Cartesian coordinate values of X, Y and Z set forth in inches in Table I wherein the Z coordinate values are perpendicular distances from planes normal to a radius from the compressor centerline and containing the X and Y values with the Z value commencing at zero in the X, Y plane at a radial aerodynamic section of the airfoil and X and Y are coordinate values which, when connected by smooth continuing arcs, define the airfoil profile at each distance Z, the profiles at the Z distances being joined smoothly with one another to form the complete airfoil shape.

2. A stator blade according to claim 1, forming part of an eleventh stage of a compressor.

3. A stator blade according to claim 1, wherein the airfoil has a shape in an envelope within ±0.100 inches in a direction normal to any airfoil surface location.

4. A stator blade according to claim 1, wherein the Z=0 value commences at a radial distance of about 17.205 inches from the compressor centerline and the Z values are increasingly positive in Table I in a radially outward direction.

5. A stator blade for a compressor having an airfoil, the airfoil having an uncoated nominal airfoil profile substantially in accordance with Cartesian coordinate values of X, Y and Z set forth in inches in Table I, wherein the Z coordinate values are perpendicular distances from planes normal to a radius from the compressor centerline and containing the X and Y values with the Z values commencing at zero in the X, Y plane at a radial aerodynamic section of the airfoil and X and Y are coordinate values which, when connected by smooth continuing arcs, define the airfoil profile at each distance Z, the profiles at the Z distances being joined smoothly with one another to form the complete airfoil profile, the X, Y and Z values being scaled as a function of the same constant or number to provide a scaled-up or scaled-down compressor airfoil.

6. A stator blade according to claim 5, forming part of an eleventh stage of the compressor.

7. A stator blade according to claim 5, wherein the airfoil has a shape in an envelope within ±0.100 inches in a direction normal to any airfoil surface location.

8. A stator blade according to claim 5, wherein the Z=0 value commences at a radial distance of about 17.205 inches from the compressor centerline and the Z values are increasingly positive in a radially outward direction.

9. A compressor comprising a plurality of stator blades forming a portion of a compressor stage, each of said blades being in the shape of an airfoil having an uncoated nominal profile substantially in accordance with Cartesian coordinate values of X, Y and Z set forth in inches in Table I, wherein the Z coordinate values are perpendicular distances from planes normal to a radius from the compressor centerline and containing the X and Y values with the Z values commencing at zero in the X, Y plane at a radial aerodynamic section of the airfoil and X and Y are coordinate values which, when connected by smooth continuing arcs, define the airfoil profile at each distance Z, the profiles at the Z distances being joined smoothly with one another to form the complete airfoil shape.

10. A compressor according to claim 9, wherein the compressor stage is the eleventh stage.

11. A compressor according to claim 9, wherein the airfoil has a shape in an envelope within ±0.100 inches in a direction normal to any airfoil surface location.

12. A compressor according to claim 9, wherein the Z=0 value commences at a radial distance of about 17.205 inches from the compressor centerline and the Z values are increasingly positive in a radially outward direction.

13. A compressor according to claim 9, wherein the X, Y and Z values are scaled as a function of the same constant or number to provide a scaled-up or scaled-down compressor airfoil.

* * * * *

UNITED STATES PATENT AND TRADEMARK OFFICE

CERTIFICATE OF CORRECTION

PATENT NO. : 7,396,211 B2
APPLICATION NO. : 11/392514
DATED : July 8, 2008
INVENTOR(S) : Tomberg et al.

It is certified that error appears in the above-identified patent and that said Letters Patent is hereby corrected as shown below:

At column 1 line 29 change the word “refine” to --define--

Signed and Sealed this

Twenty-third Day of September, 2008

JON W. DUDAS
*Director of the United States Patent and Trademark Office*